US011639562B2

(12) United States Patent
Fan et al.

(10) Patent No.: US 11,639,562 B2
(45) Date of Patent: May 2, 2023

(54) METHOD FOR PREPARING THERMAL-MOISTURE COMFORTABLE POLYESTER FDY

(71) Applicant: JIANGSU HENGLI CHEMICAL FIBRE CO., LTD., Wujiang (CN)

(72) Inventors: Hongwei Fan, Wujiang (CN); Shanshui Wang, Wujiang (CN); Lili Wang, Wujiang (CN); Lixin Yin, Wujiang (CN)

(73) Assignee: JIANGSU HENGLI CHEMICAL FIBRE CO., LTD., Wujiang (CN)

( * ) Notice: Subject to any disclaimer, the term of this patent is extended or adjusted under 35 U.S.C. 154(b) by 509 days.

(21) Appl. No.: 16/640,061

(22) PCT Filed: Jul. 27, 2018

(86) PCT No.: PCT/CN2018/097505
§ 371 (c)(1),
(2) Date: Feb. 19, 2020

(87) PCT Pub. No.: WO2019/114280
PCT Pub. Date: Jun. 20, 2019

(65) Prior Publication Data

US 2021/0054534 A1 Feb. 25, 2021

(30) Foreign Application Priority Data

Dec. 14, 2017 (CN) ..... 201711341970.8

(51) Int. Cl.
*D01D 1/06* (2006.01)
*D01D 5/12* (2006.01)
(Continued)

(52) U.S. Cl.
CPC ..... *D01F 6/92* (2013.01); *D01D 5/082* (2013.01); *D01D 5/088* (2013.01); *D01D 5/096* (2013.01);
(Continued)

(58) Field of Classification Search
CPC ..... D01D 1/06; D01D 5/08; D01D 5/082; D01D 5/088; D01D 5/096; D01D 5/12;
(Continued)

(56) References Cited

U.S. PATENT DOCUMENTS

2006/0012072 A1* 1/2006 Hagewood ..... D01D 5/253 264/177.13 X

FOREIGN PATENT DOCUMENTS

CN 1826373 A 8/2006
CN 102162143 A 8/2011
(Continued)

OTHER PUBLICATIONS

Translation of CN 103015171 A (published on Apr. 13, 2013).*
Translation of CN 106637442 A (published on May 10, 2017).*

*Primary Examiner* — Leo B Tentoni
(74) *Attorney, Agent, or Firm* — Bayramoglu Law Offices LLC

(57) ABSTRACT

A thermal-moisture comfortable polyester FDY for summer use and a preparation method thereof are provided. The FDY is made of matting agents dispersed polyester via the steps of spinning melt metering, extruding via the compositional spinneret, cooling, oiling, drawing, heat setting and winding. The woven fabrics manufactured with the FDY possess a wicking height and an evaporation rate of larger than or equal to 135 mm and 0.22 g/h, respectively. The compositional spinneret is simultaneously provided with cruciform orifices and circular orifices, and the length ratio of cruciform orifice to circular orifice is equal to the product of their
(Continued)

equivalent diameter ratio and a coefficient K, here equivalent diameter is the ratio of orifice cross-section area to its circumference and K ranges from 0.97 to 1.03, and the oiling involves the oiling agent containing 67.30-85.58 wt % of crown ether.

12 Claims, 1 Drawing Sheet

(51) Int. Cl.

| | |
|---|---|
| ***D01D 5/253*** | (2006.01) |
| ***D01F 1/10*** | (2006.01) |
| ***D01F 6/62*** | (2006.01) |
| ***D02J 1/22*** | (2006.01) |
| ***D06M 13/165*** | (2006.01) |
| ***D01F 6/92*** | (2006.01) |
| ***D01D 5/088*** | (2006.01) |
| ***D01D 5/096*** | (2006.01) |
| ***D01D 5/16*** | (2006.01) |
| ***D01D 10/02*** | (2006.01) |
| ***D01D 5/08*** | (2006.01) |
| *D06M 101/32* | (2006.01) |

(52) U.S. Cl.
CPC ..... *D01D 5/16* (2013.01); *D01D 10/02* (2013.01); *D06M 2101/32* (2013.01); *D06M 2200/40* (2013.01)

(58) Field of Classification Search
CPC ..... D01D 5/253; D01D 7/00; D01F 1/10; D01F 6/62; D02J 1/22; D06M 13/165; D06M 2101/32; D06M 2200/40
USPC ..... 264/103, 177.13, 210.3, 210.5, 210.6, 264/210.8, 211, 211.12, 211.14; 8/115.56, 115.6
See application file for complete search history.

(56) References Cited

FOREIGN PATENT DOCUMENTS

| | | | | | |
|---|---|---|---|---|---|
| CN | 102691119 | A | | 9/2012 | |
| CN | 103015171 | A | * | 4/2013 | ..... D06M 13/165 |
| CN | 105671675 | A | | 6/2016 | |
| CN | 106637442 | A | * | 5/2017 | ..... D01D 5/253 |
| CN | 107217319 | A | | 9/2017 | |
| CN | 108035010 | A | | 5/2018 | |

* cited by examiner

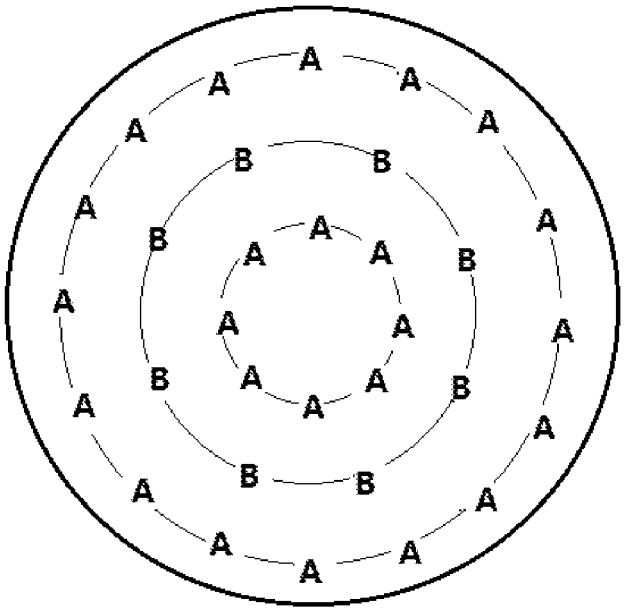
A
A
A
A
A
A
A
A
A
A
A
A
A
A
A
A
A
A
A
A
A
A
A
A
B
B
B
B
B
B
B
B
B
B
B
B

METHOD FOR PREPARING THERMAL-MOISTURE COMFORTABLE POLYESTER FDY

CROSS REFERENCE TO THE RELATED APPLICATIONS

This application is the national phase entry of International Application No. PCT/CN2018/097505, filed on Jul. 27, 2018, which is based upon and claims priority to Chinese Patent Application No. 201711341970.8, filed on Dec. 14, 2017, the entire contents of which are incorporated herein by reference.

TECHNICAL FIELD

The present invention belongs to the field of fiber manufacture, and more particularly, relates to one type of thermal-moisture comfortable polyester fully drawn yarn (FDY) and preparing method thereof.

BACKGROUND

With the improvement of people's living standard, the requirements for fabrics become higher and higher, i.e., not only fashion and elegance but also comfort has drawn much attention in everyday wear. Fabric comforts are those can cause physiological and psychological pleasures when dressed people stay in a certain environment, among which the most important aspect is the thermal-moisture comfort that promises people pleasant sensation by maintaining the constant body temperature and providing proper conditions for normal physiological function. Specifically, the so-called thermal-moisture comfort, as an important aspect of clothing performance, refers to the situation when the continuous thermal-moisture energy exchange between the human body and the environment in different climate reaches such a balance that the human body feels neither cold nor hot, and neither stuffy nor wet. As a matter of fact, clothing plays an important role in the regulation of heat and humidity energy exchange during which physical, physiological, psychological and other factors interact subtly, keeping the human body in a comfortable and contented heat and humidity balance. Therefore, the thermal-moisture comfort of clothing has been widely considered in social life. For instance, summer clothes are desired to be breathable, light and loose to reduce thermal resistance, and to be smooth for high reflectivity and less radiation heat absorption. However, it should be noted that the summer woven fabric prepared by the existing technology cannot provide satisfied thermal-moister comfort yet.

The properties of yarns and fabrics may be affected by the cross-sectional shape of fibers, which could be molded via different cross-sectional shapes and sizes of spinnerets during the fiber spinning. Specifically, the material and shape of fibers affect the properties of fibers, the arrangement of fibers in yarns affects the properties of yarns, and the arrangement of yarns in fabrics affects the properties of fabrics. Therefore, the shape of fibers is one of the essentials of yarn or fabric performance. Profiled fibers are those chemical fibers spun through spinneret orifices with certain geometric shapes to obtain special cross-section shape and function. Up to present, many kinds of profiled fibers have been explored and roughly categorized as triangle, polygon, flat, hollow, diamond and so on according to their cross-section shape. To a certain extent, shaped section improves the hand feel, luster and mechanical properties of synthetic fiber, enlarges the contact area of fiber surface with air and human body, speeds up the moisture absorption and dehumidification of fiber, increases the fiber surface energy, as well as accelerates the water evaporation rate during the dehumidification so as to release lots of heat. Therefore, profiled fiber is widely used in cool or warm feeling fabrics to improve the moisture absorption or quick drying performance. However, single shape means single function, and it is almost impossible for a fabric to obtain ideal thermal-moisture comfort performance just from one kind of fiber cross-section unless the diversification of cross-section shape.

In recent years, bi-profiled fiber or multi-profiled fiber process, i.e., co-spinning at least two types of filaments with different cross-sectional shape by means of one and the same spinneret, have been employed to combine the advantages of each filament and endue the fabric with high quality and functional diversity. Although there are literatures and patents on this field, the actual fiber production is difficult to proceed smoothly. For instance, a certain amount of pressure drop will occur during the fiber spinning when the viscoelastic polymer melt such as the non-Newtonian polyester fluid pass through the spinneret orifice, as a matter of fact, the shape, size and length of the spinneret orifice have a great impact on the pressure drop. However in the existing research about spinneret orifice during the profiled fiber manufacture, only the shape identity or cross-sectional area equality but not the interaction between shape, size and length have been considered, causing the pressure drop disaccord and the extrusion speed difference between the polyester filaments flowing out from the different shape of orifices in the same spinneret.

Therefore, overcoming the defects in the existing technology for spinning bi-profiled fibers or multi-profiled fibers from the same spinneret and preparing the yarns composed of filaments with multiple cross-section shapes so as to achieve ideal thermal-moisture comfort performance for summer use fabrics has become an urgent problem to be solved

SUMMARY

A primary object of the present invention is to provide one kind of thermal-moisture comfortable polyester FDY and preparing method thereof, so as to improve the comfort performance of woven fabrics made from the existing technology.

Another object of the present invention is to provide a method for preparing thermal-moisture comfortable polyester FDY, wherein the quality and spinnability of polyester FDY has ever been improved by adopting the crown ether oil with high heat resistance and lubricity.

Another object of the present invention is to provide a method for preparing thermal-moisture comfortable polyester FDY, wherein the spinning stability of polyester FDY has ever been promoted by adopting a compositional spinneret in which two kinds of orifices with different special shapes were installed, and the length, cross-sectional area and cross-sectional circumference of those two orifices were appropriately related.

Another object of the present invention is to provide a method for preparing thermal-moisture comfortable polyester FDY, wherein the thermal-moisture comfort originates from the combination of cruciform monofilaments and circular monofilaments extruded simultaneously from the same spinneret, which can reduce the fiber porosity and enhance the wicking effect so as to promise the wet comfort, meanwhile can realize good cohesion between two types of monofilaments to produce warm comfort.

Another object of the present invention is to provide a method for preparing thermal-moisture comfortable polyester FDY, wherein the surface of polyester FDY presents a matte state owing to the crystallization and orientation of polyester has been hindered by within dispersed inorganic matte particles such as the amorphous titanium dioxide and amorphous silicon dioxide mixture, or the calcium carbonate and amorphous silicon dioxide mixture.

Accordingly, to achieve above mentioned objects, the present invention provides a technological scheme for one type of thermal-moisture comfortable polyester FDY for summer use which is composed of cruciform monofilaments and circular monofilaments simultaneously extruded from the same spinneret, and is made of polyester dispersed within by matting agents.

In the present invention, the matting agent is chosen as a mixture of amorphous titanium dioxide and amorphous silicon dioxide, or a mixture of calcium carbonate and amorphous silicon dioxide. Pure PET fiber, as a translucent material, usually shows high surface glossiness. The glossiness of PET fiber depends not only on the reflection but also on the transmission, at the same time, is also affected by the surface state, the cross-sectional shape and the internal structure of the fiber. For instance, the fibers with high molecular orientation can cause strong light reflection and show bright gloss because of their internal uniform structure. Therefore, the glossiness of the fibers can be regulated by adding inorganic particles as delusterant or by adjusting the cross-sectional shape and surface structure of the fibers. In general, matting agents can be added in the process of PET polymerization to make the delustered fibers with glossiness close to that of cotton fibers, and the commonly used polyester matting agent is anatase titanium dioxide. In the present invention, the mixture of amorphous titanium dioxide and amorphous silica or the mixture of calcium carbonate and amorphous silica instead of anatase crystals have been chosen as the inorganic matte particles, which were evenly dispersed in PET to reduce the crystallization and orientation of PET fibers so as to make a matte surface state.

The wicking height and evaporation rate of woven fabric made of the thermal-moisture comfortable polyester FDY for summer use are not less than 135 mm and 0.22 g/h, respectively.

As a preferred technology program, for the thermal-moisture comfortable polyester FDY for summer use mentioned above, wherein the cruciform monofilaments have a fineness of 5.5-0.7 dtex and the circular monofilaments have a fineness of 0.20-0.30 dtex;

herein said the thermal-moisture comfortable polyester FDY for summer use has a fineness of 75-100 dtex, a breaking strength of greater than or equal to 3.8 cn/dtex, a breaking elongation of 33.0±3.0%, a linear density deviation rate of less than or equal to 0.5%, a breaking strength CV of less than or equal to 5.0%, a breaking elongation CV of less than or equal to 10.0%, a yarn evenness CV of less than or equal to 2.00%, a boiling water shrinkage of 7.5±0.5%, and an oil content of 0.90±0.20%.

For the thermal-moisture comfortable polyester FDY for summer use mentioned above, wherein the lousiness rate of polyester FDY is less than or equal to 2/package and the capillary parameter is larger than or equal to 0.17.

For the thermal-moisture comfortable polyester FDY for summer use mentioned above, wherein the matting agent addition is 1-1.5 wt % of the modified polyester, and the content of amorphous silica in the matting agent is 15-30 wt %.

Additionally, in the present invention a method for preparing the thermal-moisture comfortable polyester FDY for summer use mentioned above is also provided, generally including the steps of spinning melt metering, extruding via the compositional spinneret, cooling, oiling, drawing, heat setting and winding;

herein said spinning melt comprises the polyester and the matting agent;

herein said composition spinneret is simultaneously provided with cruciform orifices and circular orifices, and the length ratio of cruciform orifice to circular orifice is equal to the product of their equivalent diameter ratio and a coefficient K, here equivalent diameter is the ratio of orifice cross-section area to its circumference and K ranges from 0.97 to 1.03;

herein said oiling involves the oiling agent containing 67.30-85.58 wt % of crown ether, a heterocyclic organic compound with multiple ether groups. The wettability of crown ether surfactants is greater than that of corresponding open-chain compounds, especially, crown ethers have better solubilization. In general, salt compounds have lower solubility in organic compounds, however which could be improved if adding crown ethers. In the existing technology, the high viscosity of oils is mainly due to the inclusion of common polyester compounds or polyether compounds. Because of the larger molecular weight and hydrogen bond, the intermolecular interaction of these compounds is characterized by higher kinetic viscosity, which results in higher viscosity of oils. The viscosity of oils can be significantly reduced by adding crown ether, mainly due to the fact that the crown ether can be well compatible with polyester or polyether oils, and enter into the molecular chains of polyester or polyether compounds at the same time, shielding the interaction force between molecular chains. In the existing technology, the oil film strength of oiling agent is low mainly because the antistatic component, mainly in the form of anionic, cationic or amphoteric surfactants, contains metal ions or exists in the form of salt, which results in poor compatibility between antistatic agent and polyester or polyether compound, whereas the mechanism of crown ether improving oil film strength is that crown ether can produce salt-soluble effect when entering oiling agent, which improves the compatibility between the antistatic agent and the polyester or polyester compound, and then enhances the oil film strength. The proper oil film strength is helpful to the spinning stability and the product quality. However, the index of oiling agent is determined by comprehensive factors, therefore, the crown ether addition should neither be too low to be ineffective nor be too high to effect other factors.

As a preferred technology program, for the preparing method mentioned above, wherein the cruciform spinneret orifices or circular spinneret orifices have a length of 0.20-0.92 mm and an equivalent diameter of 0.10-0.23 mm;

All the spinneret orifices, specifically, all the center of circular orifices or all the circumferential center of cruciform orifices are arranged in regular intervals along the equally spaced concentric circles on the spinneret, and in the same ring both circular orifices and cruciform orifices are set up with a number ratio of 2-5:1.

For the preparing method mentioned above, wherein the oiling agent possesses a significantly improved thermal resistance by introducing crown ether with higher volatilization point and excellent thermal stability, and would just loss less than 15 wt % of its weight even being heated at 200° C. for 2 hours;

herein said oiling agent has a kinetic viscosity of 27.5-30.1 $mm^2/s$ at 50±0.01° C., which would become 0.93-0.95 $mm^2/s$ when the oiling agent is dispersed with a content of 10 wt % in water to form a emulsion; the viscosity of oils can be significantly reduced by adding crown ether, mainly due to the low self-viscosity and small beaded molecular shape of crown ether, therefore, the crown ether can be well compatible with polyester or polyether oils, and enter into the molecular chains of polyester or polyether compounds at the same time, shielding the interaction force between molecular chains, thus reducing the viscosity of the oils;

herein said oiling agent has an oil film strength of 121-127N, which is higher than about 110N of the common oiling agents, and the oil film strength of common oiling agent is low mainly because the antistatic component mostly contains metal ions or exists in the form of salt, which results in poor compatibility between antistatic agent and polyester or polyether compound, whereas the mechanism of crown ether improving oil film strength is that crown ether can produce salt-soluble effect when entering oiling agent, which improves the compatibility between the antistatic agent and the polyester or polyester compound, and then enhances the oil film strength;

herein said oiling agent shows a surface tension of 23.2-26.8 cN/cm and a specific resistance of $1.0\times10^8$-$1.8\times10^8\Omega\cdot$cm, and after oiling the static friction coefficient and dynamic friction coefficient between fibers are 0.250-0.263 and 0.262-0.273 respectively;

the static friction coefficient and dynamic friction coefficient between fibers and metals are 0.202-0.210 and 0.320-0.332 respectively;

herein said crown ether is one of 2-hydroxymethyl-12-crown-4, 15-crown ether-5 or 2-hydroxymethyl-15-crown-5;

herein said oiling agent also contains mineral oil, potassium phosphate, trimethylolpropane laurate and sodium alkyl sulfonate, and the mineral oil is one of 9 #-17 #mineral oil;

the phosphate potassium salt is one potassium salt of dodecyl phosphate, iso-tridecanol polyoxyethylene ether phosphate or dodeca-tetradecanol phosphate;

the sodium alkyl sulfonate is one sodium salt of dodecyl sulfonate, pentadecyl sulfonate or hexadecyl sulfonate;

herein said oiling agent should be dispersed with a content of 10-20 wt % in water to form an emulsion before used;

herein said oiling agent can be prepared via evenly mixing crown ether, potassium phosphate, trimethylolpropane laurate and sodium alkyl sulfonate and then adding the mixture into mineral oil, specially, counted by weight parts the oiling agent consists of

| | |
|---|---|
| mineral oil | 0-10 phr, |
| trimethylolpropane laurate | 0-20 phr, |
| crown ether | 70-100 phr, |
| potassium phosphate | 8-15 phr, |
| sodium alkyl sulfonate | 2-7 phr; |

moreover, the so-called mixing means a stirring process carried out at 40-55° C. for 1-3 hours.

For the preparing method mentioned above, the spinning technologies for the thermal-moisture comfortable polyester FDY for summer use could be chosen as

| | |
|---|---|
| Spinning temperature | 280-290° C., |
| Cooling temperature | 20-25° C., |
| Interlacing pressure | 0.20-0.30 MPa, |
| Speed of godet roller 1 | 2200-2600 m/min, |
| Temperature of godet roller1 | 75-85° C., |
| Speed of godet roller 2 | 3600-3900 m/min, |
| Temperature of godet roller 2 | 135-165° C., |
| Winding speed | 3580-3840 m/min, |

and the initial pressure of spinning pack is 120 bar and the pressure rising ΔP is equal to or less than 0.6 bar/day.

The mechanism of this invention could be described as follows:

Firstly, the polyester dispersed with matting agent is prepared, then the polyester melt is extruded via the compositional spinneret equipped with two types of specific shape of orifices whose length, cross section area and cross section circumference are properly designed, and the thermal-moisture comfortable polyester fibers are finally obtained from the subsequent processes of cooling, oiling with crown ether contained agent, drawing, heat setting and winding.

During the fiber spinning process, the polyester melt, as a non-Newtonian viscoelastic fluid, would deform to release the elastic energy stored during the viscous flowing through the spinneret orifices, which in fact is one of the key factors to affect the spinning stability. It is easy to understand that the length, the cross section circumference and the cross section area of those spinneret orifices have a great influence on the storage and relaxation of the elastic energy in the melt. By designing the length, the cross section area and the cross section circumference for two type of orifices in the same spinneret, as well as establishing a certain relationship between the dimensions of the two type of spinneret orifices, in the present invention the similar pressure drop for two type of orifices and the effective relaxation of elastic energy in the melt are realized, reducing the unstable die swell, thus ensuring the smooth and stable fiber spinning.

The pressure drop for a melt passing through the spinneret orifice can be calculated via the formula $$\Delta P = \frac{S_{inner}}{S_{section}} \cdot \tau$$

here ΔP is the pressure drop of spinning melt, $S_{inner}$ is the inner wall area of spinneret orifice which is equal to the product of the length and the cross section circumference of spinneret orifice, $S_{section}$ is the cross section area of spinneret orifice, while τ is the shear stress of the flowing melt.

In order to maintain the same or similar extrusion speed for the polyester melts flowing through different shape of orifice A and B in the same spinneret, the melt pressure drops for both orifices should be kept the same or within a certain difference range, i.e., $\Delta P_A = K\Delta P_B$, here the coefficient K is 0.97-1.03. Therefore, the relationship of the orifice length relative to the cross section circumference and cross section area of the orifice for both A and B can be deduced just as $$\frac{D_A}{D_B} = K\frac{S_A}{S_B} \times \frac{L_B}{L_A} = K\frac{B_A}{B_B}$$

here D is the length, S the cross section area, L the cross section circumference, and B the equivalent diameter for a certain type of spinneret orifice.

Through such designed spinneret just as mentioned above, the spinning stability and the fiber quality are warranted because the unevenness of fineness, strength and dyeing of the fiber originated from the difference pressure drop is reduced. Therefore, the cruciform shaped monofilament and the circular shaped monofilament can be extruded simultaneously from the same spinneret, and the final fibers possess the joint advantages of those two monofilaments, showing ideal thermal-moisture comfort performance and being suit for summer use fabrics.

In conclusion, the present invention provides (5) one type of applicable thermal-moisture comfortable polyester FDY for summer use containing the joint advantages of cruciform and circular monofilaments;

(6) the preparing method for the thermal-moisture comfortable polyester FDY, wherein the oiling process can improve the spinning stability and fiber processibility because the crown ether-contained oiling agent has the characteristics of low viscosity, good heat resistance, high oil film strength, good smoothness and strong antistatic property;

(7) the preparing method for the thermal-moisture comfortable polyester FDY, wherein the smooth and stable fiber spinning can be ensured by adopting a compositional spinneret in which two kinds of orifices with different special shapes are installed, and the length, cross-sectional area and cross-sectional circumference of those two orifices are appropriately related, so as to realize the similar pressure drop for the polymer melts flowing through two type of orifices;

(8) the preparing method for the thermal-moisture comfortable polyester FDY, wherein the surface of bi-profiled fiber presents a matte state owing to the crystallization and orientation of polyester has been hindered by within dispersed inorganic matte particles such as the amorphous titanium dioxide and amorphous silicon dioxide mixture, or the calcium carbonate and amorphous silicon dioxide mixture;

BRIEF DESCRIPTION OF THE DRAWING

FIGURE is the map of arrangement of orifices in the compositional spinneret used in Example 1.

DETAILED DESCRIPTION OF THE EMBODIMENTS

Based on above mentioned method, the following embodiments are carried out for further demonstration in the present invention. It is to be understood that these embodiments are only intended to illustrate the invention and are not intended to limit the scope of the invention. In addition, it should be understood that after reading the contents described in the present invention, those technical personnel in this field can make various changes or modifications to the invention, and these equivalent forms also fall within the scope of the claims attached to the application.

Example 1

A method for preparing the thermal-moisture comfortable polyester FDY for summer use, comprising the steps:

(1) Concoction of Oiling Agent 2-hydroxymethyl-12-crown-4, potassium dodecyl phosphate, trimethylolpropane laurate and sodium hexadecyl sulfonate are fully blended under room temperature and then added into the mineral oil 12 #, and stirred furtherly under a temperature of 40° C. for 2.5 h to produce the oiling agent. Counted by weight parts, the oiling agent consists of 5 phr of mineral oil 12 #, 95 phr of 2-hydroxymethyl-12-crown-4, 9 phr of potassium dodecyl phosphate and 2 phr of sodium hexadecyl sulfonate. The obtained oiling agent has a crown ether content of 85.58 wt %, a high temperature resistance (9 wt % of weight loss, after 2 hr of heating at 200° C.), a low viscosity (29.5 $mm^2/s$ of kinetic viscosity at 50±0.01° C., or 0.93 $mm^2/s$ when dispersed with a content of 10 wt % in water to form an emulsion), a high oil strength of 121N, a surface tension of 24.3 cN/m and a specific resistance of $1.0\times10^8\Omega\cdot cm$. After oiling the static friction coefficient ($\mu_s$) and dynamic friction coefficient ($\mu_d$) between fibers are 0.260 and 0.263, while the static friction coefficient and dynamic friction coefficient between fibers and metals are 0.202 and 0.330, respectively. The really applied oiling agent is a water based emulsion with a concentration of 19 wt %.

(2) The polyester is dispersed by the matting agent, i.e., the mixture of amorphous titanium dioxide and amorphous silica. The additive content of the matting agent in polyester is 1.0 wt %, and in the extinction mixture the content of amorphous silica is 22 wt %.

(3) The thermal-moisture comfortable polyester FDY for summer use is prepared from the polyester melt mentioned above through the steps of melt metering, extruding via the compositional spinneret, cooling, oiling, drawing, heat setting and winding.

Herein said compositional spinneret is simultaneously provided with cruciform orifices and circular orifices (arrangement being showed in FIGURE, in which A stands for cruciform orifices while B for circular ones), and the length ratio of cruciform orifice to circular orifice is equal to the product of their equivalent diameter ratio and a coefficient K, here equivalent diameter is the ratio of orifice cross-section area to its circumference and K value is 1.01. The length of cruciform and circular spinneret orifices are 0.38 mm and 0.38 mm respectively, while the equivalent diameter of cruciform spinneret orifices is 0.20 mm. All the spinneret orifices, specifically, all the center of circular orifices or all the circumferential center of cruciform orifices are arranged in regular intervals along the equally spaced concentric circles on the spinneret, and in the same ring both circular orifices and cruciform orifices are set up with a number ratio of 2:1. The spinning parameters in those technology steps are respectively set up as: a spinning temperature of 280° C., a cooling temperature of 21° C., an interlacing pressure of 0.25 MPa, a godet roller1 speed of 2400 m/min, a godet roller1 temperature of 78° C., a godet roller2 speed of 4050 m/min, a godet roller2 of 145° C., a winding speed of 3950 m/min, an initial spinning pack pressure of 120 bar and a spinning pack pressure rising of less than or equal to 0.6 bar/day.

The final obtained fiber is one kind of thermal-moisture polyester FDY for summer use composed of both cruciform monofilaments and circular monofilaments extruded from the same spinneret, possessing a lousiness rate of less than or equal to 2/package and a capillary parameter of 0.19, and the cruciform monofilaments have a fineness of 0.70 dtex whereas that of the circular monofilaments is 0.22 dtex. The woven fabrics (surface density of 100 $g/m^2$) made of the FDY mentioned above have a wicking height of 140 mm and an evaporation rate of 0.28 g/h. Moreover, the basic physicochemical indices of the polyester FDY are given as follows: a fineness of 100 dtex, a breaking strength of 4.2 cN/dtex, a breaking elongation of 33.0%, a linear density deviation rate of 0.33%, a breaking strength CV of 4.5%, a breaking elongation CV of 8.5%, a yarn evenness CV of 1.5%, a boiling water shrinkage of 7.5% and an oil content of 0.90%.

Example 2

A method for preparing the thermal-moisture comfortable polyester FDY for summer use, comprising the steps:

(1) Concoction of Oiling Agent 15-crown ether-5, potassium iso-tridecanol polyoxyethylene ether phosphate, trimethylolpropane laurate and sodium dodecyl sulfonate are fully blended under room temperature and then added into the mineral oil 13 #, and stirred furtherly under a temperature of 52° C. for 2 h to produce the oiling agent. Counted by weight parts, the oiling agent consists of 10 phr of mineral oil 13 #, 5 phr of trimethylolpropane laurate, 70 phr of 15-crown ether-5, 8 phr of potassium iso-tridecanol polyoxyethylene ether phosphate and 6 phr of sodium dodecyl sulfonate. The obtained oiling agent has a crown ether content of 70.70 wt %, a high temperature resistance (13.5 wt % of weight loss, after 2 hr of heating at 200° C.), a low viscosity (28.6 $mm^2/s$ of kinetic viscosity at 50±0.01° C., or 0.95 $mm^2/s$ when dispersed with a content of 10 wt % in water to form an emulsion), a high oil strength of 126N, a surface tension of 24.9 cN/m and a specific resistance of $1.2\times10^8\Omega\cdot cm$. After oiling the static friction coefficient ($\mu_s$) and dynamic friction coefficient ($\mu_d$) between fibers are 0.251 and 0.262, while the static friction coefficient and dynamic friction coefficient between fibers and metals are 0.202 and 0.332, respectively. The really applied oiling agent is a water based emulsion with a concentration of 11 wt %.

(2) The polyester is dispersed by the matting agent, i.e., the mixture of amorphous titanium dioxide and amorphous silica. The additive content of the matting agent in polyester is 1.1 wt %, and in the extinction mixture the content of amorphous silica is 28 wt %.

(3) The thermal-moisture comfortable polyester FDY for summer use is prepared from the polyester melt mentioned above through the steps of melt metering, extruding via the compositional spinneret, cooling, oiling, drawing, heat setting and winding.

Herein said compositional spinneret is simultaneously provided with cruciform orifices and circular orifices, and the length ratio of cruciform orifice to circular orifice is equal to the product of their equivalent diameter ratio and a coefficient K, here equivalent diameter is the ratio of orifice cross-section area to its circumference and K value is 0.99. The length of cruciform and circular spinneret orifices are 0.16 mm and 0.16 mm respectively, while the equivalent diameter of cruciform spinneret orifices is 0.16 mm. All the spinneret orifices, specifically, all the center of circular orifices or all the circumferential center of cruciform orifices are arranged in regular intervals along the equally spaced concentric circles on the spinneret, and in the same ring both circular orifices and cruciform orifices are set up with a number ratio of 1.2:1. The spinning parameters in those technology steps are respectively set up as: a spinning temperature of 282° C., a cooling temperature of 23° C., an interlacing pressure of 0.29 MPa, a godet roller1 speed of 2600 m/min, a godet roller1 temperature of 79° C., a godet roller2 speed of 4000 m/min, a godet roller2 of 150° C., a winding speed of 4050 m/min, an initial spinning pack pressure of 120 bar and a spinning pack pressure rising of less than or equal to 0.55 bar/day.

The final obtained fiber is one kind of thermal-moisture polyester FDY for summer use is composed of both cruciform monofilaments and circular monofilaments extruded from the same spinneret, possessing a lousiness rate of less than or equal to 2/package and a capillary parameter of 0.19, and the cruciform monofilaments have a fineness of 0.58 dtex whereas that of the circular monofilaments is 0.22 dtex. The woven fabrics (surface density of 300 $g/m^2$) made of the FDY mentioned above have a wicking height of 142 mm and an evaporation rate of 0.27 g/h. Moreover, the basic physicochemical indices of the polyester FDY are given as follows: a fineness of 75 dtex, a breaking strength of 4.0 cN/dtex, a breaking elongation of 33.0%, a linear density deviation rate of 0.45%, a breaking strength CV of 5.0%, a breaking elongation CV of 9.9%, a yarn evenness CV of 1.9%, a boiling water shrinkage of 7.0% and an oil content of 0.70%.

Example 3

A method for preparing the thermal-moisture comfortable polyester FDY for summer use, comprising the steps:

(1) Concoction of Oiling Agent 2-hydroxymethyl-15-crown-5, potassium dodeca-tetradecanol phosphate, trimethylolpropane laurate and sodium pentadecyl sulfonate are fully blended under room temperature and then added into the mineral oil 11 #, and stirred furtherly under a temperature of 48° C. for 3 h to produce the oiling agent. Counted by weight parts, the oiling agent consists of 8 phr of mineral oil 11 #, 10 phr of trimethylolpropane laurate, 85 phr of 2-hydroxymethyl-15-crown-5, 11 phr of potassium dodeca-tetradecanol phosphate and 5 phr of sodium pentadecyl sulfonate. The obtained oiling agent has a crown ether content of 70.83 wt %, a high temperature resistance (11 wt % of weight loss, after 2 hr of heating at 200° C.), a low viscosity (30.1 $mm^2/s$ of kinetic viscosity at 50±0.01° C., or 0.94 $mm^2/s$ when dispersed with a content of 10 wt % in water to form an emulsion), a high oil strength of 125N, a surface tension of 23.2 cN/m and a specific resistance of $1.8\times10^8\Omega\cdot cm$. After oiling the static friction coefficient ($\mu_s$) and dynamic friction coefficient ($\mu_d$) between fibers are 0.250 and 0.272, while the static friction coefficient and dynamic friction coefficient between fibers and metals are 0.209 and 0.329, respectively. The really applied oiling agent is a water based emulsion with a concentration of 10 wt %.

(2) The polyester is dispersed by the matting agent, i.e., the mixture of amorphous titanium dioxide and amorphous silica. The additive content of the matting agent in polyester is 1.3 wt %, and in the extinction mixture the content of amorphous silica is 20 wt %.

(3) The thermal-moisture comfortable polyester FDY for summer use is prepared from the polyester melt mentioned above through the steps of melt metering, extruding via the compositional spinneret, cooling, oiling, drawing, heat setting and winding.

Herein said compositional spinneret is simultaneously provided with cruciform orifices and circular orifices, and the length ratio of cruciform orifice to circular orifice is equal to the product of their equivalent diameter ratio and a coefficient K, here equivalent diameter is the ratio of orifice cross-section area to its circumference and K value is 1.02. The length of cruciform and circular spinneret orifices are 0.20 mm and 0.201 mm respectively, while the equivalent diameter of cruciform spinneret orifices is 0.20 mm. All the spinneret orifices, specifically, all the center of circular orifices or all the circumferential center of cruciform orifices are arranged in regular intervals along the equally spaced concentric circles on the spinneret, and in the same ring both circular orifices and cruciform orifices are set up with a number ratio of 2:1. The spinning parameters in those technology steps are respectively set up as: a spinning temperature of 288° C., a cooling temperature of 20° C., an interlacing pressure of 0.20 MPa, a godet roller1 speed of 2300 m/min, a godet roller1 temperature of 83° C., a godet roller2 speed of 4130 m/min, a godet roller2 of 165° C., a winding speed of 3980 m/min, an initial spinning pack pressure of 120 bar and a spinning pack pressure rising of less than or equal to 0.54 bar/day.

The final obtained fiber is one kind of thermal-moisture polyester FDY for summer use composed of both cruciform monofilaments and circular monofilaments extruded from the same spinneret, possessing a lousiness rate of less than or equal to 2/package and a capillary parameter of 0.17, and the cruciform monofilaments have a fineness of 0.50 dtex whereas that of the circular monofilaments is 0.20 dtex. The woven fabrics (surface density of 240 g/m$^2$) made of the FDY mentioned above have a wicking height of 139 mm and an evaporation rate of 0.28 g/h. Moreover, the basic physicochemical indices of the polyester FDY are given as follows: a fineness of 95 dtex, a breaking strength of 4.5 cN/dtex, a breaking elongation of 36.0%, a linear density deviation rate of 0.48%, a breaking strength CV of 4.8%, a breaking elongation CV of 9.5%, a yarn evenness CV of 1.4%, a boiling water shrinkage of 7.0% and an oil content of 0.70%.

Example 4

A method for preparing the thermal-moisture comfortable polyester FDY for summer use, comprising the steps:

(1) Concoction of Oiling Agent 2-hydroxymethyl-12-crown-4, potassium dodecyl phosphate, trimethylolpropane laurate and sodium hexadecyl sulfonate are fully blended under room temperature and then added into the mineral oil 12 #, and stirred furtherly under a temperature of 40° C. for 2.5 h to produce the oiling agent. Counted by weight parts, the oiling agent consists of 5 phr of mineral oil 12 #, 95 phr of 2-hydroxymethyl-12-crown-4, 9 phr of potassium dodecyl phosphate and 2 phr of sodium hexadecyl sulfonate. The obtained oiling agent has a crown ether content of 85.58 wt %, a high temperature resistance (9 wt % of weight loss, after 2 hr of heating at 200° C.), a low viscosity (29.5 mm$^2$/s of kinetic viscosity at 50±0.01° C., or 0.93 mm$^2$/s when dispersed with a content of 10 wt % in water to form an emulsion), a high oil strength of 121N, a surface tension of 24.3 cN/m and a specific resistance of $1.0\times10^8\Omega\cdot$cm. After oiling the static friction coefficient ($\mu_s$) and dynamic friction coefficient ($\mu_d$) between fibers are 0.260 and 0.263, while the static friction coefficient and dynamic friction coefficient between fibers and metals are 0.202 and 0.330, respectively. The really applied oiling agent is a water based emulsion with a concentration of 19 wt %.

(2) The polyester is dispersed by the matting agent, i.e., the mixture of amorphous titanium dioxide and amorphous silica. The additive content of the matting agent in polyester is 1.0 wt %, and in the extinction mixture the content of amorphous silica is 15 wt %.

(3) The thermal-moisture comfortable polyester FDY for summer use is prepared from the polyester melt mentioned above through the steps of melt metering, extruding via the compositional spinneret, cooling, oiling, drawing, heat setting and winding.

Herein said compositional spinneret is simultaneously provided with cruciform orifices and circular orifices, and the length ratio of cruciform orifice to circular orifice is equal to the product of their equivalent diameter ratio and a coefficient K, here equivalent diameter is the ratio of orifice cross-section area to its circumference and K value is 1.03. The length of cruciform and circular spinneret orifices are 0.32 mm and 0.32 mm respectively, while the equivalent diameter of cruciform spinneret orifices is 0.10 mm. All the spinneret orifices, specifically, all the center of circular orifices or all the circumferential center of cruciform orifices are arranged in regular intervals along the equally spaced concentric circles on the spinneret, and in the same ring both circular orifices and cruciform orifices are set up with a number ratio of 3:1. The spinning parameters in those technology steps are respectively set up as: a spinning temperature of 281° C., a cooling temperature of 21° C., an interlacing pressure of 0.22 MPa, a godet roller1 speed of 2500 m/min, a godet roller1 temperature of 75° C., a godet roller2 speed of 4200 m/min, a godet roller2 of 155° C., a winding speed of 4000 m/min, an initial spinning pack pressure of 120 bar and a spinning pack pressure rising of less than or equal to 0.58 bar/day.

The final obtained fiber is one kind of thermal-moisture polyester FDY for summer use composed of both cruciform monofilaments and circular monofilaments extruded from the same spinneret, possessing a lousiness rate of less than or equal to 2/package and a capillary parameter of 0.22 and the cruciform monofilaments have a fineness of 0.68 tex whereas that of the circular monofilaments is 0.25 dtex. The woven fabrics (surface density of 140 g/m$^2$) made of the FDY mentioned above have a wicking height of 135 mm and an evaporation rate of 0.28 g/h. Moreover, the basic physicochemical indices of the polyester FDY are given as follows: a fineness of 85 dtex, a breaking strength of 3.8 cN/dtex, a breaking elongation of 30.0%, a linear density deviation rate of 0.35%, a breaking strength CV of 5.0%, a breaking elongation CV of 8.0%, a yarn evenness CV of 1.3%, a boiling water shrinkage of 8.0% and an oil content of 1.10%.

Example 5

A method for preparing the thermal-moisture comfortable polyester FDY for summer use, comprising the steps:

(1) Concoction of Oiling Agent 15-crown ether-5, potassium iso-tridecanol polyoxyethylene ether phosphate, trimethylolpropane laurate and sodium dodecyl sulfonate are fully blended under room temperature and then added into the mineral oil 13 #, and stirred furtherly under a temperature of 52° C. for 2 h to produce the oiling agent. Counted by weight parts, the oiling agent consists of 10 phr of mineral oil 13 #, 5 phr of trimethylolpropane laurate, 70 phr of 15-crown ether-5, 8 phr of potassium iso-tridecanol polyoxyethylene ether phosphate and 6 phr of sodium dodecyl sulfonate. The obtained oiling agent has a crown ether content of 70.70 wt %, a high temperature resistance (13.5 wt % of weight loss, after 2 hr of heating at 200° C.), a low viscosity (28.6 mm$^2$/s of kinetic viscosity at 50±0.01° C., or 0.95 mm$^2$/s when dispersed with a content of 10 wt % in water to form an emulsion), a high oil strength of 126N, a surface tension of 24.9 cN/m and a specific resistance of $1.2\times10^8\Omega\cdot$cm. After oiling the static friction coefficient ($\mu_s$) and dynamic friction coefficient ($\mu_d$) between fibers are 0.251 and 0.262, while the static friction coefficient and dynamic friction coefficient between fibers and metals are 0.202 and 0.332, respectively. The really applied oiling agent is a water based emulsion with a concentration of 11 wt %.

(2) The polyester is dispersed by the matting agent, i.e., the mixture of amorphous titanium dioxide and amorphous silica. The additive content of the matting agent in polyester is 1.5 wt %, and in the extinction mixture the content of amorphous silica is 15 wt %.

(3) The thermal-moisture comfortable polyester FDY for summer use is prepared from the polyester melt mentioned above through the steps of melt metering, extruding via the compositional spinneret, cooling, oiling, drawing, heat setting and winding.

Herein said compositional spinneret is simultaneously provided with cruciform orifices and circular orifices, and the length ratio of cruciform orifice to circular orifice is equal to the product of their equivalent diameter ratio and a coefficient K, here equivalent diameter is the ratio of orifice cross-section area to its circumference and K value is 0.98. The length of cruciform and circular spinneret orifices are 0.54 mm and 0.54 mm respectively, while the equivalent diameter of cruciform spinneret orifices is 0.16 mm. All the spinneret orifices, specifically, all the center of circular orifices or all the circumferential center of cruciform orifices are arranged in regular intervals along the equally spaced concentric circles on the spinneret, and in the same ring both circular orifices and cruciform orifices are set up with a number ratio of 4:1. The spinning parameters in those technology steps are respectively set up as: a spinning temperature of 290° C., a cooling temperature of 25° C., an interlacing pressure of 0.26 MPa, a godet roller1 speed of 2200 m/min, a godet roller1 temperature of 75° C., a godet roller2 speed of 4150 m/min, a godet roller2 of 135° C., a winding speed of 4050 m/min, an initial spinning pack pressure of 120 bar and a spinning pack pressure rising of less than or equal to 0.5 bar/day.

The final obtained fiber is one kind of thermal-moisture polyester FDY for summer use composed of both cruciform monofilaments and circular monofilaments extruded from the same spinneret, possessing a lousiness rate of less than or equal to 2/package and a capillary parameter of 0.19, and the cruciform monofilaments have a fineness of 0.59 dtex whereas that of the circular monofilaments is 0.27 dtex. The woven fabrics (surface density of 260 g/m$^2$) made of the FDY mentioned above have a wicking height of 140 mm and an evaporation rate of 0.22 g/h. Moreover, the basic physicochemical indices of the polyester FDY are given as follows: a fineness of 100 dtex, a breaking strength of 4.4 cN/dtex, a breaking elongation of 33.0%, a linear density deviation rate of 0.46%, a breaking strength CV of 4.8%, a breaking elongation CV of 9.6%, a yarn evenness CV of 1.8%, a boiling water shrinkage of 7.5% and an oil content of 1.10%.

Example 6

A method for preparing the thermal-moisture comfortable polyester FDY for summer use, comprising the steps:

(1) Concoction of Oiling Agent 2-hydroxymethyl-15-crown-5, potassium dodeca-tetradecanol phosphate, trimethylolpropane laurate and sodium pentadecyl sulfonate are fully blended under room temperature and then added into the mineral oil 14 #, and stirred furtherly under a temperature of 55° C. for 1 h to produce the oiling agent. Counted by weight parts, the oiling agent consists of 3 phr of mineral oil 14 #, 10 phr of trimethylolpropane laurate, 75 phr of 2-hydroxymethyl-15-crown-5, 14 phr of potassium dodeca-tetradecanol phosphate and 10 phr of sodium pentadecyl sulfonate. The obtained oiling agent has a crown ether content of 68.80 wt %, a high temperature resistance (12 wt % of weight loss, after 2 hr of heating at 200° C.), a low viscosity (27.5 mm$^2$/s of kinetic viscosity at 50±0.01° C., or 0.95 mm$^2$/s when dispersed with a content of 10 wt % in water to form an emulsion), a high oil strength of 126N, a surface tension of 25.4 cN/m and a specific resistance of $1.6\times10^8\Omega\cdot$cm. After oiling the static friction coefficient ($\mu_s$) and dynamic friction coefficient ($\mu_d$) between fibers are 0.255 and 0.267, while the static friction coefficient and dynamic friction coefficient between fibers and metals are 0.203 and 0.330, respectively. The really applied oiling agent is a water based emulsion with a concentration of 20 wt %.

(2) The polyester is dispersed by the matting agent, i.e., the mixture of amorphous titanium dioxide and amorphous silica. The additive content of the matting agent in polyester is 1.5 wt %, and in the extinction mixture the content of amorphous silica is 24 wt %.

(3) The thermal-moisture comfortable polyester FDY for summer use is prepared from the polyester melt mentioned above through the steps of melt metering, extruding via the compositional spinneret, cooling, oiling, drawing, heat setting and winding.

Herein said compositional spinneret is simultaneously provided with cruciform orifices and circular orifices, and the length ratio of cruciform orifice to circular orifice is equal to the product of their equivalent diameter ratio and a coefficient K, here equivalent diameter is the ratio of orifice cross-section area to its circumference and K value is 1.00. The length of cruciform and circular spinneret orifices are 0.59 mm and 0.59 mm respectively, while the equivalent diameter of cruciform spinneret orifices is 0.19 mm. All the spinneret orifices, specifically, all the center of circular orifices or all the circumferential center of cruciform orifices are arranged in regular intervals along the equally spaced concentric circles on the spinneret, and in the same ring both circular orifices and cruciform orifices are set up with a number ratio of 2:1. The spinning parameters in those technology steps are respectively set up as: a spinning temperature of 285° C., a cooling temperature of 24° C., an interlacing pressure of 0.30 MPa, a godet roller1 speed of 2500 m/min, a godet roller1 temperature of 85° C., a godet roller2 speed of 4090 m/min, a godet roller2 of 140° C., a winding speed of 3950 m/min, an initial spinning pack pressure of 120 bar and a spinning pack pressure rising of less than or equal to 0.6 bar/day.

The final obtained fiber is one kind of thermal-moisture polyester FDY for summer use composed of both cruciform monofilaments and circular monofilaments extruded from the same spinneret, possessing a lousiness rate of less than or equal to 2/package and a capillary parameter of 0.18, and the cruciform monofilaments have a fineness of 0.70 dtex whereas that of the circular monofilaments is 0.30 dtex. The woven fabrics (surface density of 210 g/m$^2$) made of the FDY mentioned above have a wicking height of 138 mm and an evaporation rate of 0.30 g/h. Moreover, the basic physicochemical indices of the polyester FDY are given as follows: a fineness of 75 dtex, a breaking strength of 4.0 cN/dtex, a breaking elongation of 36.0%, a linear density deviation rate of 0.5%, a breaking strength CV of 4.2%, a breaking elongation CV of 9.1%, a yarn evenness CV of 2.0%, a boiling water shrinkage of 8.0% and an oil content of 0.90%.

Example 7

A method for preparing the thermal-moisture comfortable polyester FDY for summer use, comprising the steps:

(1) Concoction of Oiling Agent 15-crown ether-5, potassium dodecyl phosphate, trimethylolpropane laurate and sodium hexadecyl sulfonate are fully blended under room temperature and then added into the mineral oil 15 #, and stirred furtherly under a temperature of 41° C. for 2 h to produce the oiling agent. Counted by weight parts, the oiling agent consists of 8 phr of mineral oil 15 #, 20 phr of trimethylolpropane laurate, 100 phr of 15-crown ether-5, 15 phr of potassium dodecyl phosphate and 2 phr of sodium hexadecyl sulfonate. The obtained oiling agent has a crown ether content of 68.97 wt %, a high temperature resistance (8.5 wt % of weight loss, after 2 hr of heating at 200° C.), a low viscosity (28.4 $mm^2/s$ of kinetic viscosity at 50±0.01° C., or 0.94 $mm^2/s$ when dispersed with a content of 10 wt % in water to form an emulsion), a high oil strength of 122N, a surface tension of 26.8 cN/m and a specific resistance of $1.8\times10^8\Omega\cdot cm$. After oiling the static friction coefficient ($\mu_s$) and dynamic friction coefficient ($\mu_d$) between fibers are 0.263 and 0.268, while the static friction coefficient and dynamic friction coefficient between fibers and metals are 0.210 and 0.320, respectively. The really applied oiling agent is a water based emulsion with a concentration of 13 wt %.

(2) The polyester is dispersed by the matting agent, i.e., the mixture of amorphous titanium dioxide and amorphous silica. The additive content of the matting agent in polyester is 1.1 wt %, and in the extinction mixture the content of amorphous silica is 28 wt %.

(3) The thermal-moisture comfortable polyester FDY for summer use is prepared from the polyester melt mentioned above through the steps of melt metering, extruding via the compositional spinneret, cooling, oiling, drawing, heat setting and winding.

Herein said compositional spinneret is simultaneously provided with cruciform orifices and circular orifices, and the length ratio of cruciform orifice to circular orifice is equal to the product of their equivalent diameter ratio and a coefficient K, here equivalent diameter is the ratio of orifice cross-section area to its circumference and K value is 0.97. The length of cruciform and circular spinneret orifices are 0.92 mm and 0.92 mm respectively, while the equivalent diameter of cruciform spinneret orifices is 0.18 mm. All the spinneret orifices, specifically, all the center of circular orifices or all the circumferential center of cruciform orifices are arranged in regular intervals along the equally spaced concentric circles on the spinneret, and in the same ring both circular orifices and cruciform orifices are set up with a number ratio of 5:1. The spinning parameters in those technology steps are respectively set up as: a spinning temperature of 289° C., a cooling temperature of 20° C., an interlacing pressure of 0.29 MPa, a godet roller1 speed of 2600 m/min, a godet roller1 temperature of 78° C., a godet roller2 speed of 4140 m/min, a godet roller2 of 160° C., a winding speed of 4130 m/min, an initial spinning pack pressure of 120 bar and a spinning pack pressure rising of less than or equal to 0.46 bar/day.

The final obtained fiber is one kind of thermal-moisture polyester FDY for summer use composed of both cruciform monofilaments and circular monofilaments extruded from the same spinneret, possessing a lousiness rate of less than or equal to 2/package and a capillary parameter of 0.16, and the cruciform monofilaments have a fineness of 0.58 dtex whereas that of the circular monofilaments is 0.24 dtex. The woven fabrics (surface density of 180 $g/m^2$) made of the FDY mentioned above have a wicking height of 137 mm and an evaporation rate of 0.33 g/h. Moreover, the basic physicochemical indices of the polyester FDY are given as follows: a fineness of 95 dtex, a breaking strength of 4.6 cN/dtex, a breaking elongation of 30.0%, a linear density deviation rate of 0.44%, a breaking strength CV of 4.3%, a breaking elongation CV of 9.2%, a yarn evenness CV of 1.5%, a boiling water shrinkage of 7.5% and an oil content of 0.90%.

Example 8

A method for preparing the thermal-moisture comfortable polyester FDY for summer use, comprising the steps:

(1) Concoction of Oiling Agent 2-hydroxymethyl-12-crown-4, potassium dodeca-tetradecanol phosphate, trimethylolpropane laurate and sodium pentadecyl sulfonate are fully blended under room temperature and then added into the mineral oil 16 #, and stirred furtherly under a temperature of 45° C. for 3 h to produce the oiling agent. Counted by weight parts, the oiling agent consists of 9 phr of mineral oil 16 #, 80 phr of 2-hydroxymethyl-12-crown-4, 12 phr of potassium dodeca-tetradecanol phosphate and 5 phr of sodium pentadecyl sulfonate. The obtained oiling agent has a crown ether content of 83.33 wt %, a high temperature resistance (14 wt % of weight loss, after 2 hr of heating at 200° C.), a low viscosity (30.0 $mm^2/s$ of kinetic viscosity at 50±0.01° C., or 0.93 $mm^2/s$ when dispersed with a content of 10 wt % in water to form an emulsion), a high oil strength of 127N, a surface tension of 23.5 cN/m and a specific resistance of $1.5\times10^8\Omega\cdot cm$. After oiling the static friction coefficient ($\mu_s$) and dynamic friction coefficient ($\mu_d$) between fibers are 0.262 and 0.273, while the static friction coefficient and dynamic friction coefficient between fibers and metals are 0.208 and 0.328, respectively. The really applied oiling agent is a water based emulsion with a concentration of 18 wt %.

(2) The polyester is dispersed by the matting agent, i.e., the mixture of amorphous titanium dioxide and amorphous silica. The additive content of the matting agent in polyester is 1.4 wt %, and in the extinction mixture the content of amorphous silica is 30 wt %.

(3) The thermal-moisture comfortable polyester FDY for summer use is prepared from the polyester melt mentioned above through the steps of melt metering, extruding via the compositional spinneret, cooling, oiling, drawing, heat setting and winding.

Herein said compositional spinneret is simultaneously provided with cruciform orifices and circular orifices, and the length ratio of cruciform orifice to circular orifice is equal to the product of their equivalent diameter ratio and a coefficient K, here equivalent diameter is the ratio of orifice cross-section area to its circumference and K value is 1.01 The length of cruciform and circular spinneret orifices are 0.32 mm and 0.32 mm respectively, while the equivalent diameter of cruciform spinneret orifices is 0.16 mm. All the spinneret orifices, specifically, all the center of circular orifices or all the circumferential center of cruciform orifices are arranged in regular intervals along the equally spaced concentric circles on the spinneret, and in the same ring both circular orifices and cruciform orifices are set up with a number ratio of 4:1. The spinning parameters in those technology steps are respectively set up as: a spinning temperature of 280° C., a cooling temperature of 20° C., an interlacing pressure of 0.25 MPa, a godet roller1 speed of 2300 m/min, a godet roller1 temperature of 80° C., a godet roller2 speed of 4000 m/min, a godet roller2 of 155° C., a winding speed of 3970 m/min, an initial spinning pack pressure of 120 bar and a spinning pack pressure rising of less than or equal to 0.4 bar/day.

The final obtained fiber is one kind of thermal-moisture polyester FDY for summer use composed of both cruciform monofilaments and circular monofilaments extruded from the same spinneret, possessing a lousiness rate of less than or equal to 2/package and a capillary parameter of 0.21, and the cruciform monofilaments have a fineness of 0.55 dtex whereas that of the circular monofilaments is 0.25 dtex. The woven fabrics (surface density of 190 g/m$^2$) made of the FDY mentioned above have a wicking height of 145 mm and an evaporation rate of 0.24 g/h. Moreover, the basic physicochemical indices of the polyester FDY are given as follows: a fineness of 75 dtex, a breaking strength of 3.8 cN/dtex, a breaking elongation of 36.0%, a linear density deviation rate of 0.5%, a breaking strength CV of 5.0%, a breaking elongation CV of 10.0%, a yarn evenness CV of 1.9%, a boiling water shrinkage of 7.0% and an oil content of 0.70%.

Example 9

A method for preparing the thermal-moisture comfortable polyester FDY for summer use, comprising the steps:

(1) Concoction of Oiling Agent 2-hydroxymethyl-15-crown-5, potassium dodecyl phosphate, trimethylolpropane laurate and sodium dodecyl sulfonate are fully blended under room temperature and then stirred furtherly under a temperature of 55° C. for 3 h to produce the oiling agent. Counted by weight parts, the oiling agent consists of 15 phr of trimethylolpropane laurate, 90 phr of 2-hydroxymethyl-15-crown-5, 8 phr of potassium dodecyl phosphate and 7 phr of sodium dodecyl sulfonate. The obtained oiling agent has a crown ether content of 81.81 wt %, a high temperature resistance (10 wt % of weight loss, after 2 hr of heating at 200° C.), a low viscosity (29.7 mm$^2$/s of kinetic viscosity at 50±0.01° C., or 0.94 mm$^2$/s when dispersed with a content of 10 wt % in water to form an emulsion), a high oil strength of 126N, a surface tension of 24.8 cN/m and a specific resistance of $1.8\times10^8\Omega\cdot$cm. After oiling the static friction coefficient ($\mu_s$) and dynamic friction coefficient ($\mu_d$) between fibers are 0.250 and 0.264, while the static friction coefficient and dynamic friction coefficient between fibers and metals are 0.210 and 0.321, respectively. The really applied oiling agent is a water based emulsion with a concentration of 10 wt %.

(2) The polyester is dispersed by the matting agent, i.e., the mixture of amorphous titanium dioxide and amorphous silica. The additive content of the matting agent in polyester is 1.5 wt %, and in the extinction mixture the content of amorphous silica is 30 wt %.

(3) The thermal-moisture comfortable polyester FDY for summer use is prepared from the polyester melt mentioned above through the steps of melt metering, extruding via the compositional spinneret, cooling, oiling, drawing, heat setting and winding.

Herein said compositional spinneret is simultaneously provided with cruciform orifices and circular orifices, and the length ratio of cruciform orifice to circular orifice is equal to the product of their equivalent diameter ratio and a coefficient K, here equivalent diameter is the ratio of orifice cross-section area to its circumference and K value is 1.03 The length of cruciform and circular spinneret orifices are 0.60 mm and 0.60 mm respectively, while the equivalent diameter of cruciform spinneret orifices is 0.23 mm. All the spinneret orifices, specifically, all the center of circular orifices or all the circumferential center of cruciform orifices are arranged in regular intervals along the equally spaced concentric circles on the spinneret, and in the same ring both circular orifices and cruciform orifices are set up with a number ratio of 2:1. The spinning parameters in those technology steps are respectively set up as: a spinning temperature of 283° C., a cooling temperature of 23° C., an interlacing pressure of 0.30 MPa, a godet roller1 speed of 2500 m/min, a godet roller1 temperature of 79° C., a godet roller2 speed of 4130 m/min, a godet roller2 of 135° C., a winding speed of 4010 m/min, an initial spinning pack pressure of 120 bar and a spinning pack pressure rising of less than or equal to 0.38 bar/day.

The final obtained fiber is one kind of thermal-moisture polyester FDY for summer use composed of both cruciform monofilaments and circular monofilaments extruded from the same spinneret, possessing a lousiness rate of less than or equal to 2/package and a capillary parameter of 0.27, and the cruciform monofilaments have a fineness of 0.69 dtex whereas that of the circular monofilaments is 0.30 dtex. The woven fabrics (surface density of 140 g/m$^2$) made of the FDY mentioned above have a wicking height of 144 mm and an evaporation rate of 0.26 g/h. Moreover, the basic physicochemical indices of the polyester FDY are given as follows: a fineness of 85 dtex, a breaking strength of 4.5 cN/dtex, a breaking elongation of 33.0%, a linear density deviation rate of 0.39%, a breaking strength CV of 3.5%, a breaking elongation CV of 9.4%, a yarn evenness CV of 1.4%, a boiling water shrinkage of 7.0% and an oil content of 0.90%.

Example 10

A method for preparing the thermal-moisture comfortable polyester FDY for summer use, comprising the steps:

(1) Concoction of Oiling Agent 2-hydroxymethyl-15-crown-5, potassium dodecyl phosphate, trimethylolpropane laurate and sodium dodecyl sulfonate are fully blended under room temperature and then stirred furtherly under a temperature of 55° C. for 3 h to produce the oiling agent. Counted by weight parts, the oiling agent consists of 15 phr of trimethylolpropane laurate, 90 phr of 2-hydroxymethyl-15-crown-5, 8 phr of potassium dodecyl phosphate and 7 phr of sodium dodecyl sulfonate. The obtained oiling agent has a crown ether content of 81.81 wt %, a high temperature resistance (10 wt % of weight loss, after 2 hr of heating at 200° C.), a low viscosity (29.7 mm$^2$/s of kinetic viscosity at 50±0.01° C., or 0.94 mm$^2$/s when dispersed with a content of 10 wt % in water to form an emulsion), a high oil strength of 126N, a surface tension of 24.8 cN/m and a specific resistance of $1.8\times10^8\Omega\cdot$cm. After oiling the static friction coefficient ($\mu_s$) and dynamic friction coefficient ($\mu_d$) between fibers are 0.250 and 0.264, while the static friction coefficient and dynamic friction coefficient between fibers and metals are 0.210 and 0.321, respectively. The really applied oiling agent is a water based emulsion with a concentration of 10 wt %.

(2) The polyester is dispersed by the matting agent, i.e., the mixture of amorphous titanium dioxide and amorphous silica. The additive content of the matting agent in polyester is 1.3 wt %, and in the extinction mixture the content of amorphous silica is 18 wt %.

(3) The thermal-moisture comfortable polyester FDY for summer use is prepared from the polyester melt mentioned above through the steps of melt metering, extruding via the compositional spinneret, cooling, oiling, drawing, heat setting and winding.

Herein said compositional spinneret is simultaneously provided with cruciform orifices and circular orifices, and the length ratio of cruciform orifice to circular orifice is equal to the product of their equivalent diameter ratio and a coefficient K, here equivalent diameter is the ratio of orifice cross-section area to its circumference and K value is 1.02 The length of cruciform and circular spinneret orifices are 0.32 mm and 0.326 mm respectively, while the equivalent diameter of cruciform spinneret orifices is 0.19 mm. All the spinneret orifices, specifically, all the center of circular orifices or all the circumferential center of cruciform orifices are arranged in regular intervals along the equally spaced concentric circles on the spinneret, and in the same ring both circular orifices and cruciform orifices are set up with a number ratio of 3:1. The spinning parameters in those technology steps are respectively set up as: a spinning temperature of 286° C., a cooling temperature of 24° C., an interlacing pressure of 0.27 MPa, a godet roller1 speed of 2400 m/min, a godet roller1 temperature of 75° C., a godet roller2 speed of 4200 m/min, a godet roller2 of 165° C., a winding speed of 3980 m/min, an initial spinning pack pressure of 120 bar and a spinning pack pressure rising of less than or equal to 0.55 bar/day.

The final obtained fiber is one kind of thermal-moisture polyester FDY for summer use composed of both cruciform monofilaments and circular monofilaments extruded from the same spinneret, possessing a lousiness rate of less than or equal to 2/package and a capillary parameter of 0.17, and the cruciform monofilaments have a fineness of 0.65 dtex whereas that of the circular monofilaments is 0.29 dtex. The woven fabrics (surface density of 170 g/m$^2$) made of the FDY mentioned above have a wicking height of 141 mm and an evaporation rate of 0.31 g/h. Moreover, the basic physicochemical indices of the polyester FDY are given as follows: a fineness of 80 dtex, a breaking strength of 4.1 cN/dtex, a breaking elongation of 36.0%, a linear density deviation rate of 0.37%, a breaking strength CV of 3.9%, a breaking elongation CV of 8.9%, a yarn evenness CV of 1.5%, a boiling water shrinkage of 7.5% and an oil content of 1.10%.

Example 11

A method for preparing the thermal-moisture comfortable polyester FDY for summer use, comprising the steps:

(1) Concoction of Oiling Agent 2-hydroxymethyl-12-crown-4, potassium dodecyl phosphate, trimethylolpropane laurate and sodium dodecyl sulfonate are fully blended under room temperature and then added into the mineral oil 9 #, and stirred furtherly under a temperature of 40° C. for 1 h to produce the oiling agent. Counted by weight parts, the oiling agent consists of 2 phr of mineral oil 9 #, 10 phr of trimethylolpropane laurate, 90 phr of 2-hydroxymethyl-12-crown-4, 8 phr of potassium dodecyl phosphate and 3 phr of sodium dodecyl sulfonate. The obtained oiling agent has a crown ether content of 79.6 wt %, a high temperature resistance (14.5 wt % of weight loss, after 2 hr of heating at 200° C.), a low viscosity (29.6 mm$^2$/s of kinetic viscosity at 50±0.01° C., or 0.93 mm$^2$/s when dispersed with a content of 10 wt % in water to form an emulsion), a high oil strength of 125N, a surface tension of 24.8 cN/m and a specific resistance of $1.83\times10^8\Omega\cdot$cm. After oiling the static friction coefficient ($\mu_s$) and dynamic friction coefficient ($\mu_d$) between fibers are 0.255 and 0.266, while the static friction coefficient and dynamic friction coefficient between fibers and metals are 0.203 and 0.320, respectively. The really applied oiling agent is a water based emulsion with a concentration of 15 wt %.

(2) The polyester is dispersed by the matting agent, i.e., the mixture of amorphous titanium dioxide and amorphous silica. The additive content of the matting agent in polyester is 1.2 wt %, and in the extinction mixture the content of amorphous silica is 15 wt %.

(3) The thermal-moisture comfortable polyester FDY for summer use is prepared from the polyester melt mentioned above through the steps of melt metering, extruding via the compositional spinneret, cooling, oiling, drawing, heat setting and winding.

Herein said compositional spinneret is simultaneously provided with cruciform orifices and circular orifices, and the length ratio of cruciform orifice to circular orifice is equal to the product of their equivalent diameter ratio and a coefficient K, here equivalent diameter is the ratio of orifice cross-section area to its circumference and K value is 1.03 The length of cruciform and circular spinneret orifices are 0.80 mm and 0.80 mm respectively, while the equivalent diameter of cruciform spinneret orifices is 0.12 mm. All the spinneret orifices, specifically, all the center of circular orifices or all the circumferential center of cruciform orifices are arranged in regular intervals along the equally spaced concentric circles on the spinneret, and in the same ring both circular orifices and cruciform orifices are set up with a number ratio of 2:1. The spinning parameters in those technology steps are respectively set up as: a spinning temperature of 287° C., a cooling temperature of 25° C., an interlacing pressure of 0.24 MPa, a godet roller1 speed of 2300 m/min, a godet roller1 temperature of 85° C., a godet roller2 speed of 4100 m/min, a godet roller2 of 150° C., a winding speed of 4140 m/min, an initial spinning pack pressure of 120 bar and a spinning pack pressure rising of less than or equal to 0.57 bar/day.

The final obtained fiber is one kind of thermal-moisture polyester FDY for summer use composed of both cruciform monofilaments and circular monofilaments extruded from the same spinneret, possessing a lousiness rate of less than or equal to 2/package and a capillary parameter of 0.18, and the cruciform monofilaments have a fineness of 0.50 dtex whereas that of the circular monofilaments is 0.21 dtex. The woven fabrics (surface density of 280 g/m$^2$) made of the FDY mentioned above have a wicking height of 138 mm and an evaporation rate of 0.29 g/h. Moreover, the basic physicochemical indices of the polyester FDY are given as follows: a fineness of 100 dtex, a breaking strength of 4.3 cN/dtex, a breaking elongation of 30.0%, a linear density deviation rate of 0.44%, a breaking strength CV of 4.8%, a breaking elongation CV of 8.5%, a yarn evenness CV of 2.0%, a boiling water shrinkage of 8.0% and an oil content of 0.90%.

What is claimed is:

1. A method for preparing a thermal-moisture comfortable polyester FDY, comprising: performing metering, extruding via a spinneret, cooling, oiling, drawing, heat setting and winding on a spinning melt to obtain the thermal-moisture comfortable polyester FDY for summer;

wherein the spinning melt comprises the polyester and a matting agent;

wherein the spinneret is simultaneously provided with a plurality of cruciform orifices and a plurality of circular orifices; a ratio of a length of each cruciform orifice of the plurality of cruciform orifices to a length of each circular orifice of the plurality of circular orifices is equal to a product of a ratio of an equivalent diameter of the each cruciform orifice to an equivalent diameter of the each circular orifice and a coefficient K, the equivalent diameter of the each cruciform orifice is a ratio of a cross-sectional area to a cross-sectional circumference of the each cruciform orifice, the equivalent diameter of the each circular orifice is a ratio of a cross-sectional area to a cross-sectional circumference of the each circular orifice, and the coefficient K ranges from 0.97 to 1.03;

an oiling agent in the oiling contains 67.30 wt %-85.58 wt % of crown ether.

2. The method for preparing the thermal-moisture comfortable polyester FDY of claim 1, wherein the length of the each cruciform orifice or the length of the each circular orifice is 0.20 mm-0.92 mm, the equivalent diameter of the each cruciform orifice or the equivalent diameter of the each circular orifice is 0.10 mm-0.23 mm;

wherein the plurality of circular orifices and the plurality of cruciform orifices are arranged on the spinneret; centers of the plurality of circular orifices or circumferential centers of the plurality of cruciform orifices are arranged in regular intervals on a plurality of equally spaced concentric circles; a plurality of orifices of the plurality of cruciform orifices and the plurality of circular orifices are arranged on a same circle; the plurality of orifices on the same circle comprises cruciform orifices and circular orifices, and a quantity ratio of the circular orifices to the cruciform orifices is 2-5:1.

3. The method for preparing the thermal-moisture comfortable polyester FDY of claim 1, wherein a weight loss of the oiling agent is less than 15 wt % after a heat treatment at 200° C. for 2 hours;

wherein the oiling agent has a kinetic viscosity of 27.5 $mm^2/s$–30.1 $mm^2/s$ at 50±0.01° C. and the kinetic viscosity becomes 0.93 $mm^2/s$–0.95 $mm^2/s$ when the oiling agent is dispersed with a content of 10 wt % in water to form an emulsion;

wherein the oiling agent has an oil film strength of 121 N–127 N;

wherein the oiling agent has a surface tension of 23.2 cN/cm-26.8 cN/cm and a specific resistance of $1.0\times10^8\Omega\cdot cm$-$1.8\times10^8\Omega\cdot cm$;

after the oiling, a static friction coefficient between the thermal-moisture comfortable polyester FDYs is 0.250-0.263, and a dynamic friction coefficient between the thermal-moisture comfortable polyester FDYs is 0.262-0.273; and after the oiling, a static friction coefficient between the thermal-moisture comfortable polyester FDY and a metal is 0.202-0.210, and a dynamic friction coefficient between the thermal-moisture comfortable polyester FDY and the metal is 0.320-0.332.

4. The method for preparing the thermal-moisture comfortable polyester FDY of claim 3, wherein the crown ether is 2-hydroxymethyl-12-crown-4, 15-crown ether-5 or 2-hydroxymethyl-15-crown-5;

the oiling agent further contains a mineral oil, a potassium phosphate, trimethylolpropane laurate and sodium alkyl sulfonate;

the mineral oil is one selected from the group consisting of 9 #-17 #mineral oil;

the phosphate potassium salt is a potassium salt of dodecyl phosphate, iso-tridecanol polyoxyethylene ether phosphate or dodeca-tetradecanol phosphate;

the sodium alkyl sulfonate is a sodium salt of dodecyl sulfonate, pentadecyl sulfonate or hexadecyl sulfonate;

the oiling agent before used is dispersed with a content of 10 wt %-20 wt % in water to form the emulsion; and a method for preparing the oiling agent comprises: mixing the crown ether, the potassium phosphate, the trimethylolpropane laurate and the sodium alkyl sulfonate to obtain a first mixture, and then adding the first mixture into the mineral oil to obtain the oiling agent; an amount of each of the mineral oil, the phosphate potassium salt, the trimethylolpropane laurate, the crown ether, and the sodium alkyl sulfonate by weight is as follows:

mineral oil 0 phr-10 phr, trimethylolpropane laurate 0 phr-20 phr, crown ether 70 phr-100 phr, potassium phosphate 8 phr-15 phr, sodium alkyl sulfonate 2 phr-7 phr, the mixing is carried out by performing a stirring at 40° C.–55° C. for 1 hour-3 hours.

5. The method for preparing the thermal-moisture comfortable polyester FDY of claim 1, wherein a plurality of spinning process parameters of the thermal-moisture comfortable polyester FDY for summer are as follows:

spinning temperature 280° C.–290° C.;

cooling temperature 20° C.–25° C.;

interlacing pressure 0.20 MPa–0.30 MPa;

speed of a first godet roller 2200 m/min–2600 m/min;

temperature of the first godet roller 75° C.–85° C.;

speed of a second godet roller 3600 m/min–3900 m/min;

temperature of the second godet roller 135° C.–165° C.;

winding speed 3580 m/min–3840 m/min; and an initial pressure of a spinning pack is 120 bar and a pressure rising ΔP is equal to or less than 0.6 bar/day.

6. The method for preparing the thermal-moisture comfortable polyester FDY of claim 1, wherein a cruciform monofilament has a fineness of 0.5 dtex-0.7 dtex and a circular monofilament has a fineness of 0.20 dtex-0.30 dtex.

7. The method for preparing the thermal-moisture comfortable polyester FDY of claim 1, wherein the thermal-moisture comfortable polyester FDY for summer use has a fineness of 70 dtex-100 dtex, a breaking strength of greater than or equal to 3.8 cn/dtex, a breaking elongation of 33.0:±:3.0%, a linear density deviation rate of less than or equal to 0.5%, a breaking strength CV of less than or equal to 5.0%, a breaking elongation CV of less than or equal to 10.0%, a yarn evenness CV of less than or equal to 2.00%, a boiling water shrinkage of 7.5±0.5%, and an oil content of 0.90±0.20%.

8. The method for preparing the thermal-moisture comfortable polyester FDY of claim 7, wherein the thermal-moisture comfortable polyester FDY for summer use has a lousiness rate of less than or equal to 2 per package and a capillary parameter of larger than or equal to 0.17.

9. The method for preparing the thermal-moisture comfortable polyester FDY of claim 1, wherein an additive content of the matting agent in the polyester is 1 wt %-1.5 wt %, and a content of the amorphous silicon dioxide in matte mixture is 15 wt %-30 wt %.

10. The method for preparing the thermal-moisture comfortable polyester FDY of claim 2, wherein a plurality of spinning process parameters of the thermal-moisture comfortable polyester FDY for summer are as follows:

spinning temperature 280° C.–290° C.;

cooling temperature 20° C.–25° C.;

interlacing pressure 0.20 MPa–0.30 MPa;

speed of a first godet roller 2200 m/min–2600 m/min;

temperature of the first godet roller 75° C.–85° C.;

speed of a second godet roller 3600 m/min–3900 m/min;

temperature of the second godet roller 135° C.–165° C.;

winding speed 3580 m/min–3840 m/min; and an initial pressure of a spinning pack is 120 bar and a pressure rising ΔP is equal to or less than 0.6 bar/day.

11. The method for preparing the thermal-moisture comfortable polyester FDY of claim 3, wherein a plurality of spinning process parameters of the thermal-moisture comfortable polyester FDY for summer are as follows:

spinning temperature 280° C.–290° C.;

cooling temperature 20° C.–25° C.;

interlacing pressure 0.20 MPa–0.30 MPa;

speed of a first godet roller 2200 m/min–2600 m/min;

temperature of the first godet roller 75° C.–85° C.;

speed of a second godet roller 3600 m/min–3900 m/min;

temperature of the second godet roller 135° C.–165° C.;

winding speed 3580 m/min–3840 m/min; and an initial pressure of a spinning pack is 120 bar and a pressure ruing ΔP is equal to or less than 0.6 bar/day.

12. The method for preparing the thermal-moisture comfortable polyester FDY of claim 4, wherein a plurality of spinning process parameters of the thermal-moisture comfortable polyester FDY for summer are as follows:

spinning temperature 280° C.–290° C.;

cooling temperature 20° C.–25° C.;

interlacing pressure 0.20 MPa–0.30 MPa;

speed of a first godet roller 2200 m/min–2600 m/min;

temperature of the first godet roller 75° C.–85° C.;

speed of a second godet roller 3600 m/min–3900 m/min;

temperature of the second godet roller 135° C.–165° C.;

winding speed 3580 m/min–3840 m/min; and an initial pressure of a spinning pack is 120 bar and a pressure rising ΔP is equal to or less than 0.6 bar/day.

* * * * *